US008515319B2

(12) United States Patent
Takemoto

(10) Patent No.: US 8,515,319 B2
(45) Date of Patent: Aug. 20, 2013

(54) DEVELOPING UNIT AND IMAGE FORMING APPARATUS USING SAME

(75) Inventor: Kazuhiko Takemoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 301 days.

(21) Appl. No.: 12/881,801

(22) Filed: Sep. 14, 2010

(65) Prior Publication Data

US 2011/0222919 A1 Sep. 15, 2011

(30) Foreign Application Priority Data

Mar. 12, 2010 (JP) ..... 2010-055481

(51) Int. Cl.
*G03G 15/09* (2006.01)

(52) U.S. Cl.
USPC ..... 399/273; 399/272

(58) Field of Classification Search
USPC ..... 399/272, 273
See application file for complete search history.

(56) References Cited

U.S. PATENT DOCUMENTS 4,213,617 A * 7/1980 Salger ..... 399/104
5,978,634 A * 11/1999 Sato et al. ..... 399/277
5,991,585 A * 11/1999 Nakamura ..... 399/267
2004/0218945 A1* 11/2004 Yokokawa ..... 399/104
2009/0245887 A1 10/2009 Masuda et al.

FOREIGN PATENT DOCUMENTS

JP 11-044997 A 2/1999
JP 2009-244611 A 10/2009
JP 2009244611 A * 10/2009

* cited by examiner

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

A developing unit includes: a cylindrical magnetic member having plural magnetic poles in a circumferential direction, the magnetic poles including a first pole attracting developer and a second pole not attracting developer; a developer holding member having the cylindrical magnetic member therein and conveying developer magnetically attracted by the cylindrical magnetic member on a surface thereof in a direction toward a predetermined area where developer is not attracted by a magnetic field caused by the second pole; a peeling member provided in the predetermined area and peeling off the developer attracted at an end portion of the developer holding member in an axial direction; and a second magnetic member provided on at least one of an upstream side and a downstream side of the peeling member, disposed in a position with a gap from the surface of the developer holding member and opposed to the predetermined area.

13 Claims, 11 Drawing Sheets

FIG. 9

| | PV | | | | | | | | | |
|---|---|---|---|---|---|---|---|---|---|---|
| PRINTING CONDITION | 1 | 2 | 3 | 4 | 5 | 6 | 7 | 8 | 9 | 10 |
| TWO MAGNETIC MEMBERS | ○ | ○ | ○ | ○ | ○ | ○ | ○ | ○ | ○ | ○ |
| ONE MAGNETIC MEMBER | ○⁻ | △ | △ | ○⁻ | △ | △⁻ | △ | △ | △ | ○⁻ |

○ : BETTER
△ : GOOD

DEVELOPING UNIT AND IMAGE FORMING APPARATUS USING SAME

CROSS-REFERENCE TO RELATED APPLICATIONS

This application is based on and claims priority under 35 USC 119 from Japanese Patent Application No. 2010-055481 filed on Mar. 12, 2010.

BACKGROUND

1. Technical Field

The present invention relates to a developing unit and an image forming apparatus using same.

2. Related Art

There is proposed a technology capable of preventing density decrease and density unevenness in an end portion, in the axial direction, of the development roll in the developing unit.

SUMMARY

According to an aspect of the invention, a developing unit includes: a cylindrical magnetic member having a plurality of magnetic poles in a circumferential direction, the plurality of magnetic poles including a first pole attracting developer and a second pole not attracting developer; a developer holding member that has the cylindrical magnetic member therein and conveys developer magnetically attracted by the cylindrical magnetic member on a surface thereof in a direction toward a predetermined area where developer is not attracted by a magnetic field caused by the second pole; a peeling member that is provided in the predetermined area and peels off the developer attracted at an end portion of the developer holding member in an axial direction; and a second magnetic member that is provided on at least one of upstream and downstream in the direction from the peeling member and that is disposed in a position with a gap from the surface of the developer holding member and opposed to the predetermined area.

BRIEF DESCRIPTION OF THE DRAWINGS

Exemplary embodiment(s) of the present invention will be described in detail based on the following figures, wherein:

FIG. 9 is a graph showing a test result;

DETAILED DESCRIPTION

Hereinafter, exemplary embodiments of the present invention will be described with reference to the drawings.

First Embodiment

Figure 2:
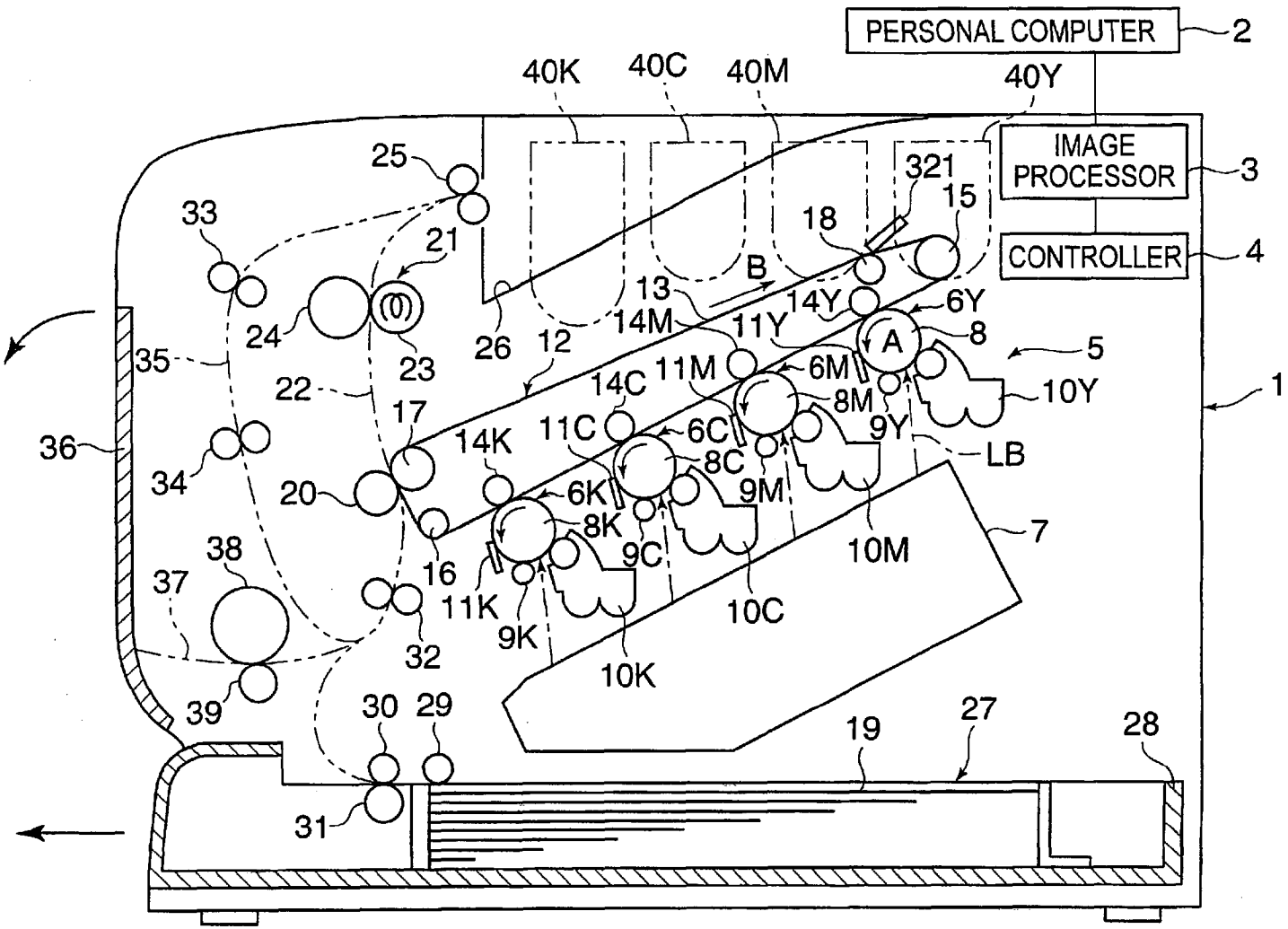
FIG. 2 is a structural view showing a tandem color printer as an image forming apparatus to which the developing unit according to the first embodiment of the present invention is applied.

FIG. 2 is a structural view showing a tandem color printer as an image forming apparatus to which a developing unit according to a first embodiment of the present invention is applied.

As shown in FIG. 2, this color printer outputs full-color and monochrome images according to image data outputted from a personal computer, a non-illustrated image reading apparatus or the like or image data transmitted through a telephone line, a LAN or the like.

In a color printer main body 1, as shown in FIG. 2, an image processor 3 and a controller 4 are disposed. The image processor 3 performs, as required, predetermined image processings such as shading correction, position displacement correction, lightness/color space conversion, gamma correction, frame erasure, color/movement editing on the image data transmitted from a personal computer (PC) 2, a non-illustrated image reading apparatus or the like. The controller 4 controls the overall operation of the color printer.

Then, the image data having undergone the predetermined image processings by the image processor 3 as described above is converted into image data of four colors of yellow (Y), magenta (M), cyan (C) and black (K) also by the image processor 3, and outputted as a full-color image or a monochrome image by an image outputter 5 provided in the color printer main body 1 as described next.

In the color printer main body 1, as shown in FIG. 2, four image forming units (image forming portions) 6Y, 6M, 6C and 6K of yellow (Y), magenta (M), cyan (C) and black (K) are disposed in parallel at predetermined intervals in a condition of being inclined at a predetermined angle with respect to the horizontal direction so that the image forming unit 6Y of the first color yellow (Y) is relatively high and the image forming unit 6K of the last color black (K) is relatively low.

By thus disposing the four image forming units 6Y, 6M, 6C and 6K of yellow (Y), magenta (M), cyan (C) and black (K) in a condition of being inclined at the predetermined angle, compared with when the four image forming units 6Y, 6M, 6C and 6K are disposed horizontally, the distances between the image forming units 6Y, 6M, 6C and 6K can be made short, so that the width of the color printer main body 1 can be reduced and this enables a further size reduction.

The four image forming units 6Y, 6M, 6C and 6K are, basically, structured similarly except for the colors of the images that they form, and as shown in FIG. 2, broadly, includes: a photoconductor drum 8 as the image holder rotated at a predetermined speed in the direction of the arrow A by non-illustrated driving means; a charging roll 9 for primary charging that uniformly charges the surface of the photoconductor drum 8; an image exposing unit 7 that exposes an image according to the image data corresponding to a predetermined color to thereby form an electrostatic latent image on the surface of the photoconductor drum 8; a developing unit 10 that develops the electrostatic latent image formed on the surface of the photoconductor drum 8 with toner of the predetermined color; and a cleaning unit 11 that cleans the surface of the photoconductor drum 8.

As the photoconductor drum 8, for example, a drum-shaped one with a diameter of approximately 30 mm is used that has the surface thereof covered with a photoconductive layer made of an organic photoconductor (OPC) or the like. The photoconductor drum 8 is rotated at the predetermined speed in the direction of the arrow A by a non-illustrated driving motor.

As the charging roll 9, for example, a roll-form charger is used in which the surface of a metal core is coated with a conductive layer made of a synthetic resin, a synthetic rubber or the like and having an adjusted electric resistance. A predetermined charging bias is applied to the metal core of the charging roll 9.

The image exposing unit 7 is common to the four image forming units 6Y, 6M, 6C and 6K as shown in FIG. 2, and forms electrostatic latent images corresponding to the image data by applying a laser beam LB subjected to deflection scanning according to the image data of the corresponding color, to the surfaces of the photoconductor drums 8Y, 8M, 8C and 8K. The image exposing unit 7 is not limited to the one using a laser beam, but an LED array or the like arranged so as to correspond to the photoconductor drums 8Y, 8M, 8C and 8K may be used.

From the image processor 3, the image data of the corresponding color is successively outputted to the image exposing unit 7 common to the image forming units 6Y, 6M, 6C and 6K of yellow (Y), magenta (M), cyan (C) and black (K). Scanning exposure by the laser beam LB emitted from the image exposing unit 7 according to the image data is performed on the surfaces of the corresponding photoconductor drums 8Y, 8M, 8C and 8K, thereby forming electrostatic latent images corresponding to the image data. The electrostatic latent images formed on the surfaces of the photoconductor drums 8Y, 8M, 8C and 8K are developed into toner images of yellow (Y), magenta (M), cyan (C) and black (K) by the developing units 10Y, 10M, 10C and 10K, respectively.

The toner images of yellow (Y), magenta (M), cyan (C) and black (K) successively formed on the photoconductor drums 8Y, 8M, 8C and 8K of the image forming units 6Y, 6M, 6C and 6K are primarily transferred in succession so as to be superimposed one on another by four primary transfer rolls 14Y, 14M, 14C and 14K onto an intermediate transfer belt 13 as an intermediate transfer member of an intermediate transfer unit 12 disposed in a condition of being inclined over the image forming units 6Y, 6M, 6C and 6K.

The intermediate transfer belt 13 is an endless belt member stretched by a plurality of rolls, and disposed in a condition of being inclined with respect to the horizontal direction so that the lower running area of the belt member is relatively low on the downstream side in the running direction thereof and relatively high on the upstream side.

That is, as shown in FIG. 2, the intermediate transfer belt 13 is trained around a driving roll 15, a following roll 16, a back support roll 17 of a secondary transfer portion and a following roll 18 with a predetermined tension, and is circulated at a predetermined speed in the direction of the arrow B by the driving roll 15 rotated by a non-illustrated driving motor that is excellent in maintaining constant speed. As the intermediate transfer belt 13, for example, one is used that is formed as an endless belt of a synthetic resin film of polyimide, polyamide-imide or the like having flexibility. The intermediate transfer belt 13 is disposed so as to be in contact with the photoconductor drums 8Y, 8M, 8C and 8K of the image forming units 6Y, 6M, 6C and 6K in the lower running area thereof.

On the intermediate transfer belt 13, as shown in FIG. 2, a secondary transfer roll 20 as secondary transfer means disposed at a low position side end of the upper running area of the intermediate transfer belt 13 and secondarily transferring the toner image primarily transferred onto the intermediate transfer belt 13, onto a recording medium 19 is disposed so as to be in contact with the surface of the intermediate transfer belt 13 stretched along the back support roll 17.

The toner images of yellow (Y), magenta (M), cyan (C) and black (K) transferred onto the intermediate transfer belt 13 so as to be superimposed one on another are secondarily transferred all together onto the recording sheet 19 as the recording medium by the secondary transfer roll 20 that is in contact with the back support roll 17 through the intermediate transfer belt 13 as shown in FIG. 2. The recording sheet 19 having the toner images of the colors transferred thereto is conveyed to a fixing unit 21 situated above in the vertical direction through a sheet conveyance path 22. The secondary transfer roll 20 which is pressed against a side of the back support roll 17 through the intermediate transfer belt 13 secondarily transfers the toner images of the colors all together onto the recording sheet 19 conveyed from below to above in the vertical direction.

As the secondary transfer roll 20, for example, one is used in which the outer periphery of a core made of a metal such as stainless steel is coated with an elastic layer of a predetermined thickness made of a conductive elastic material such as a synthetic rubber material to which a conductive agent is added.

The recording sheet 19 having the toner images of the colors transferred thereto undergoes fixing by heat and pressure by a heating roll 23 and a pressurizing belt (or a pressurizing roll) 24 of the fixing unit 21, and then, ejected by ejection rolls 25 with the image side down onto an ejection tray 26 provided at an upper end of the printer main body 1.

As the recording sheet 19, a sheet of a predetermined size and material is fed from a paper feed tray 28 of a paper feeding unit 27 disposed at the bottom in the color printer main body 1 in a condition of being separated one by one by a paper feed roll 29 and a pair of sheet separation rolls 30 and 31, and is once conveyed to registration rolls 32. The recording sheet 19 fed from the paper feed tray 28 is sent out to a secondary transfer position of the intermediate transfer belt 13 by the registration rolls 32 rotated in synchronism with the toner images on the intermediate transfer belt 13. As the recording sheet 19, thick paper such as coated paper having the front side or both the front and back sides thereof covered with a coating can be fed as well as plain paper. A photo image and the like are outputted to the recording sheet 19 consisting of coated paper.

Residual toner on the surface of the photoconductor drum 8 where the primary transfer process of the toner images has been finished is removed by the cleaning unit 11 as shown in FIG. 2 in preparation for the next image formation.

Residual toner and the like on the surface of the intermediate transfer belt 13 where the secondary transfer process of the toner images has been finished are removed by a cleaning unit 321 for the belt disposed in the neighborhood on the upstream side of the driving roll 15 as shown in FIG. 2 in preparation for the next image formation.

When an image is formed on both sides of the recording sheet 19, the recording sheet 19 having an image formed on one side thereof is not ejected by the ejection rolls 25 as it is onto the ejection tray 26 provided at the upper end of the printer main body 1 but is conveyed back to the registration rolls 32 in a reversed condition by rotating the ejection rolls 25 in the opposite direction with the rear end of the recording sheet 19 being held by the ejection rolls 25 and switching the sheet conveyance path to a conveyance path 35 for two-side image formation where conveyance rolls 33 and 34 are disposed, and an image is formed on the other side of the recording sheet 19.

In the above-described color printer, the recording sheet 19 of a desired size and material can be fed not only from the paper feed tray 28 but also from a manual paper feed tray 36 openably and closably provided on the front side of the printer main body 1 shown as the left side in FIG. 2. The recording sheets 19 that are set in the manual paper feed tray 36 are fed in a condition of being separated one by one by a pair of sheet separation conveyance rolls 38 and 39 through a manual paper feed conveyance path 37, and conveyed to the registration rolls 32.

In FIG. 2, reference numerals 40Y, 40M, 40C and 40K represent toner cartridges supplying toners or developers consisting of toner and carrier of the colors corresponding to the developing units 10Y, 10M, 10C and 10K of yellow (Y), magenta (M), cyan (C) and black (K), respectively. In the present embodiment, developers consisting of toner and carrier are supplied from the toner cartridges 40Y, 40M, 40C and 40K.

Figure 1:
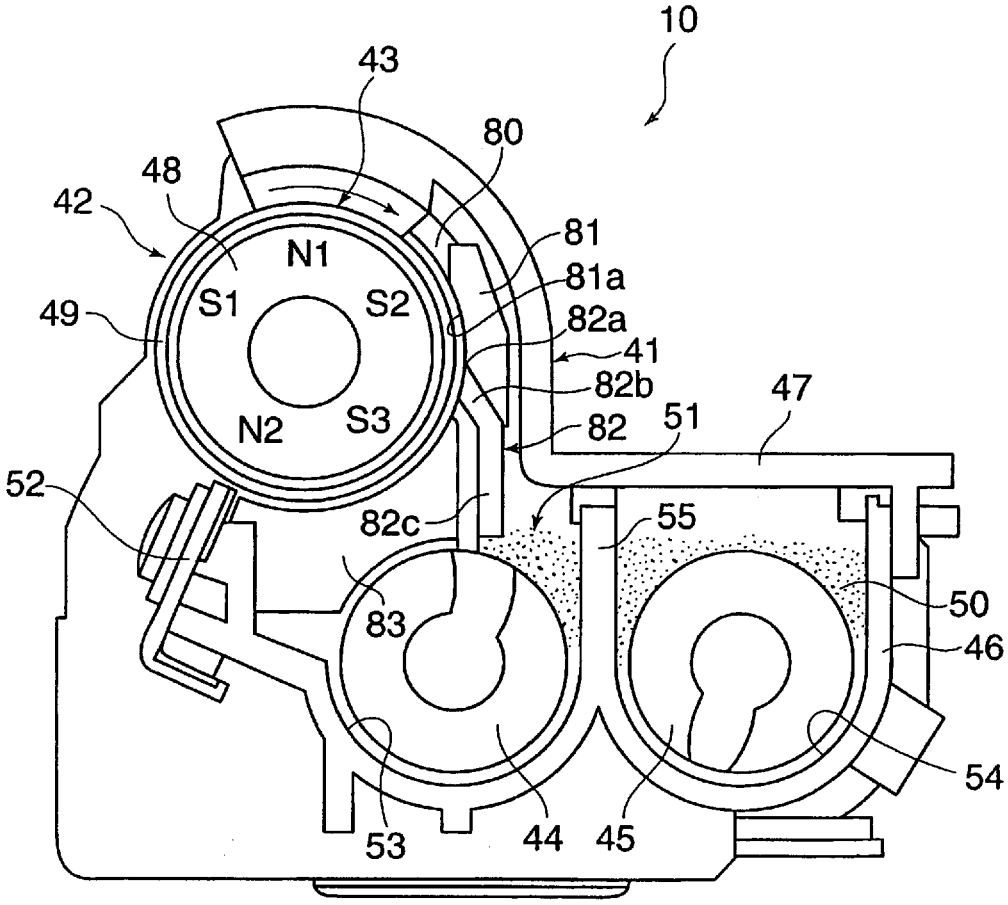
FIG. 1 is a cross-sectional structural view showing a developing unit according to a first embodiment of the present invention.

FIG. 1 is a structural view showing the developing unit according to the first embodiment of the present invention.

As shown in FIG. 1, broadly, the developing unit 10 includes: a developing unit main body 41; a development roll 43 as the developer holding member disposed in an opening 42 provided in one side surface (in FIG. 1, the left side surface) in an upper part of the developing unit main body 41; two developer stirring and conveying augers 44 and 45 disposed in parallel on the back side obliquely below the development roll 43.

The developing unit main body 41 includes a lower housing 46 and an upper housing 47. The opening 42 is provided in a position corresponding to one side surface of the upper housing 47. The development roll 43 as the developer holding member is disposed in the opening 42. The development roll 43 includes: a magnet roll 48 as the cylindrical magnetic member disposed inside in a fixed condition; and a development sleeve 49 disposed on the outer periphery of the magnet roll 48 so as to be rotatable in the direction of the arrow.

As described above, the developing unit 10 is provided with the development roll 43 and the two developer stirring and conveying augers 44 and 45 disposed in parallel on the back side obliquely therebelow, and by reducing the diameters of the development roll 43 and the two developer stirring and conveying augers 44 and 45 with the printer size reduction by the reduction in the diameter of the photoconductor drum 8, the developing unit 10 itself is thin and flat, and reduced in size.

Figure 3:
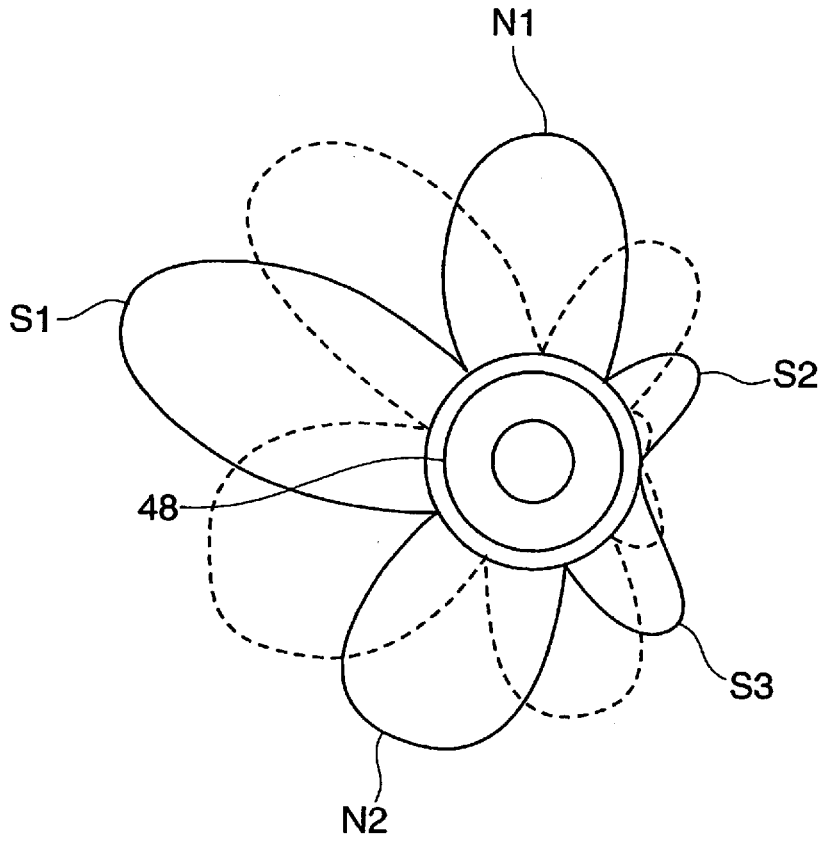
FIG. 3 is a structural view showing the arrangement of magnetic poles of a magnet roll.

As shown in FIG. 3, the magnet roll 48 has in the rotating direction of the development roll 43: a development pole S1 formed in a development position opposed to the photoconductor drum 8; a conveyance pole N1 conveying developer; a peeling pole S2 peeling the developer from the surface of the development roll 43; an absorption pole S3 acting on the peeling pole S2 and absorbing the developer to be conveyed to the development pole S1; and a conveyance pole N2 formed in a position corresponding to a developer restricting member 52. These magnetic poles are formed in predetermined positions on the outer periphery of the ferrite or synthetic resin magnet roll 48 so as to have predetermined magnitudes of magnetic forces. The magnet roll 48 conveys the developer along the outer periphery of the development sleeve 49 successively by the magnetic poles N2, S1, N1 and S2 of different polarities along the outer periphery of the magnet roll 48, and peels off the developer from the surface of the development sleeve 49 by the peeling pole S2 and the absorption pole S3 of the same polarity adjoining each other. The magnet roll 48 may be formed by combining a plurality of magnets.

In FIG. 3, the solid lines represent the components, in the normal direction, of the magnetic forces at the magnetic poles, and the broken lines represent the components, in the tangential direction, of the magnetic forces at the magnetic poles.

The developer 50 absorbed to the surface of the development roll 43 by the magnetic force of the magnet roll 48 is, as shown in FIG. 1, magnetically absorbed to the surface of the development sleeve 49 by the absorption pole S3 as the development sleeve 49 rotates. Then, under a condition where the amount of developer 50 is restricted by the developer restricting member 52 as the development sleeve 49 rotates, the developer 50 becomes erected chains of a predetermined amount and is conveyed to the development pole S1. The conveyance pole N2 which also acts as a layer restricting pole is provided in a position corresponding to the developer restricting member 52. On the development roll 43, after the electrostatic latent image on the surface of the photoconductor drum 8 is developed by the erected chains (magnetic brush) of the developer 50 formed on the surface of the development sleeve 49, the developer 50 is conveyed to the peeling pole S2 through the conveyance pole N1 as the development sleeve 49 rotates. Then, the developer 50 is all peeled from the surface of the development sleeve 49 once, and then, new developer 50 is absorbed to the surface of the development sleeve 49 by the absorption pole S3.

Below the development roll 43, as shown in FIG. 1, a developer container 51 is provided that is formed by the lower housing 46 as a space for accommodating the two-component developer 50 consisting of, for example, toner and carrier (magnetic powder), and in the lower housing 46, the developer restricting member 52 that restricts the amount of developer 50 supplied to the surface of the development roll 43 is disposed in a position on the upstream side in the rotating direction of the development roll 43, in the neighborhood of the opening 42 and corresponding to the conveyance pole N2 with a predetermined gap from the surface of the development roll 43.

In the lower housing 46, as shown in FIG. 1, the following are disposed: the first stirring and conveying auger 44 as a first developer stirring and conveying member in which the two-component developer 50 consisting of toner and carrier is accommodated and that supplies the developer 50 to the surface of the development roll 43 by conveying it while stirring it; and the second stirring and conveying auger 45 as a second developer stirring and conveying member that conveys the developer 50 while stirring it. The developer container 51 formed inside the lower housing 46 is partitioned by a partition wall 55 into a first stirring and conveying auger housing 53 as a first developer stirring and conveying member housing in which the first stirring and conveying auger 44 is housed and a second stirring and conveying auger housing 54 as a second developer stirring and conveying member housing in which the second stirring and conveying auger 45 is housed.

Figure 4:
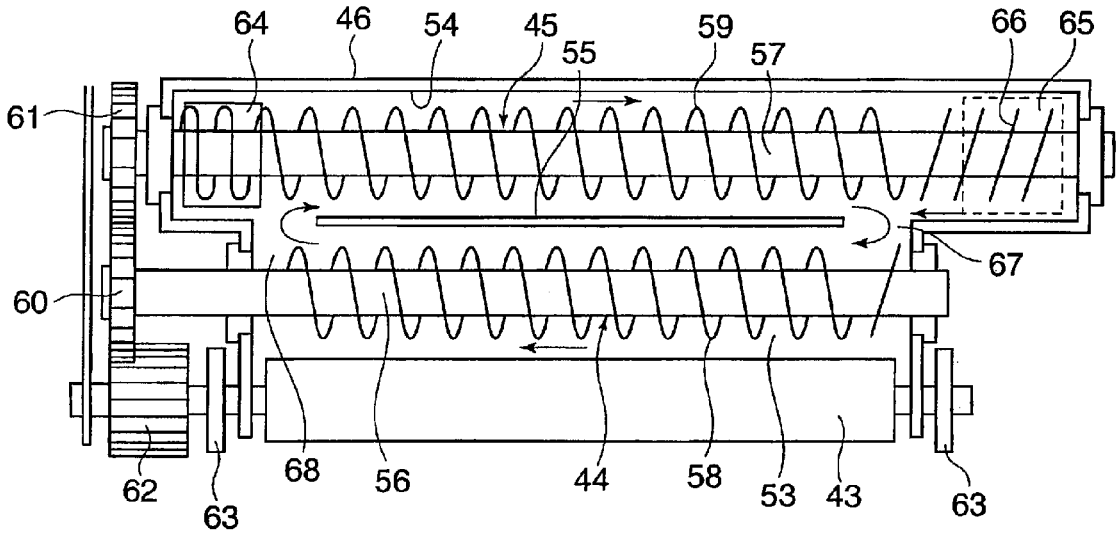
FIG. 4 is a schematic structural view showing the developing unit according to the first embodiment of the present invention.

As shown in FIG. 4, the first and second stirring and conveying augers 44 and 45 include: cylindrical rotary shafts 56 and 57; and stirring and conveying blades 58 and 59 helically formed on the outer peripheries of the rotary shafts 56 and 57.

The first and second stirring and conveying augers 44 and 45 convey the developer 50 in opposite directions while stirring it.

As shown in FIG. 4, the first and second stirring and conveying augers 44 and 45 are rotated by gears 60 and 61 attached to the ends of the rotary shafts 56 and 57. The gear 60 meshes with a driving gear 62 provided at an end of the development roll 43. In FIG. 4, reference numeral 63 represents a tracking roll provided at each end of the development roll 43 and rotating while abutting on the surface of the photoconductor drum 8 so that the distance from the surface of the photoconductor drum 8 is a predetermined value.

At one end of the second stirring and conveying auger 45 in the axial direction, as shown in FIG. 4, a supply opening 64 through which developer is supplied from the toner cartridge 40 (see FIG. 2) is formed in the ceiling surface. At the other end of the second stirring and conveying auger 45 in the axial direction, a discharge opening 65 through which excessive developer 50 is discharged little by little from the second stirring and conveying auger housing 54 to the outside is formed in the bottom surface.

Moreover, at the other end of the second stirring and conveying auger 45 in the axial direction, a restricting auger 66 for restricting the amount of excessive developer 50 discharged from the discharge opening 65, to a predetermined small amount is provided so as to convey the developer 50 in the opposite direction.

In the developing unit 10, as shown in FIG. 4, the partition wall 55 as a partition between the first stirring and conveying auger housing 53 and the second stirring and conveying auger housing 54 is provided, and circulation paths 67 and 68 for circulating the developer 50 between the first stirring and conveying auger housing 53 and the second stirring and conveying auger housing 54 are formed at both ends of the partition wall 55.

In the developing unit 10, as shown in FIG. 4, the developer 50 at least containing new toner is supplied to one end of the second stirring and conveying auger 45 in the axial direction, is conveyed in the axial direction of the second stirring and conveying auger 45, is delivered to the first stirring and conveying auger 44 through the path 67 provided in the neighborhood of the other end of the second stirring and conveying auger 45 in the axial direction, is supplied to the surface of the development roll 43 while being conveyed in the axial direction of the first stirring and conveying auger 44, and is then delivered to the second stirring and conveying auger 45 through the path 68 provided at the end of the first stirring and conveying auger 44 in the axial direction.

At that time, part of the developer 50 delivered from the second stirring and conveying auger 45 to the first stirring and conveying auger 44 through the path 67 is conveyed to the other end of the second stirring and conveying auger 45 in the axial direction, and is discharged to the outside little by little from the discharge opening 65 provided in the bottom surface at the end of the second stirring and conveying auger 45 in the axial direction.

In the developing unit 10, when the developer 50 having passed through the development area in a condition of being held on the surface of the development roll 43 as shown in FIG. 1 passes the peeling pole S2 and the absorption pole S3, the magnetic force abruptly decreases to substantially zero between the peeling pole S2 and the absorption pole S3 as shown in FIG. 3, so that the developer 50 is once peeled from the surface of the development roll 43 and new developer 50 is magnetically absorbed to the surface of the development roll 43 by the absorption pole S3 to be held thereon.

Figure 5:
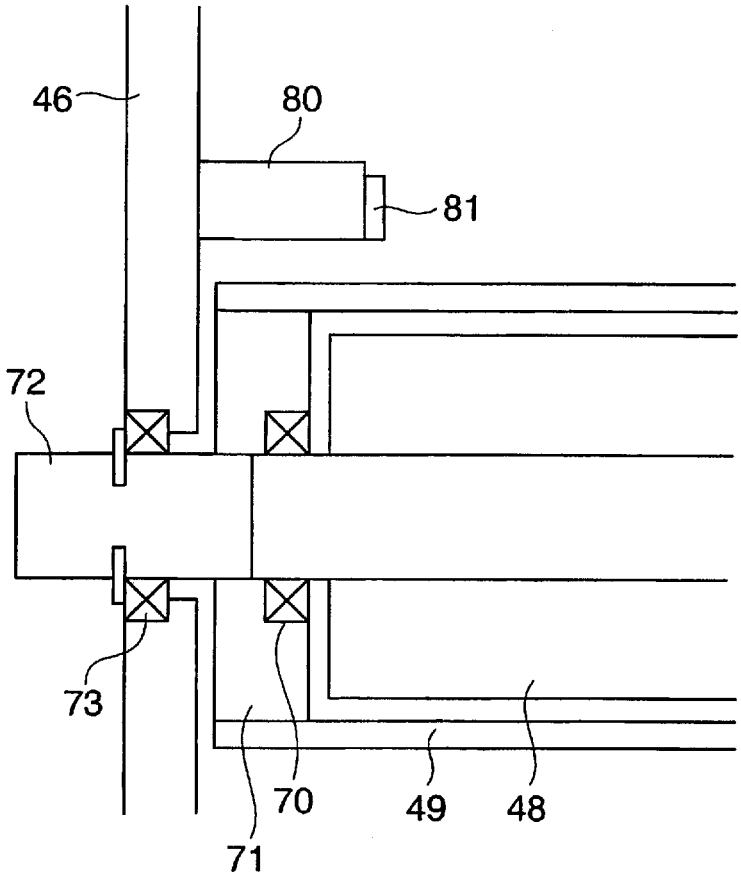
FIG. 5 is a cross-sectional structural view showing a relevant part of the developing unit according to the first embodiment of the present invention.
Figure 6:
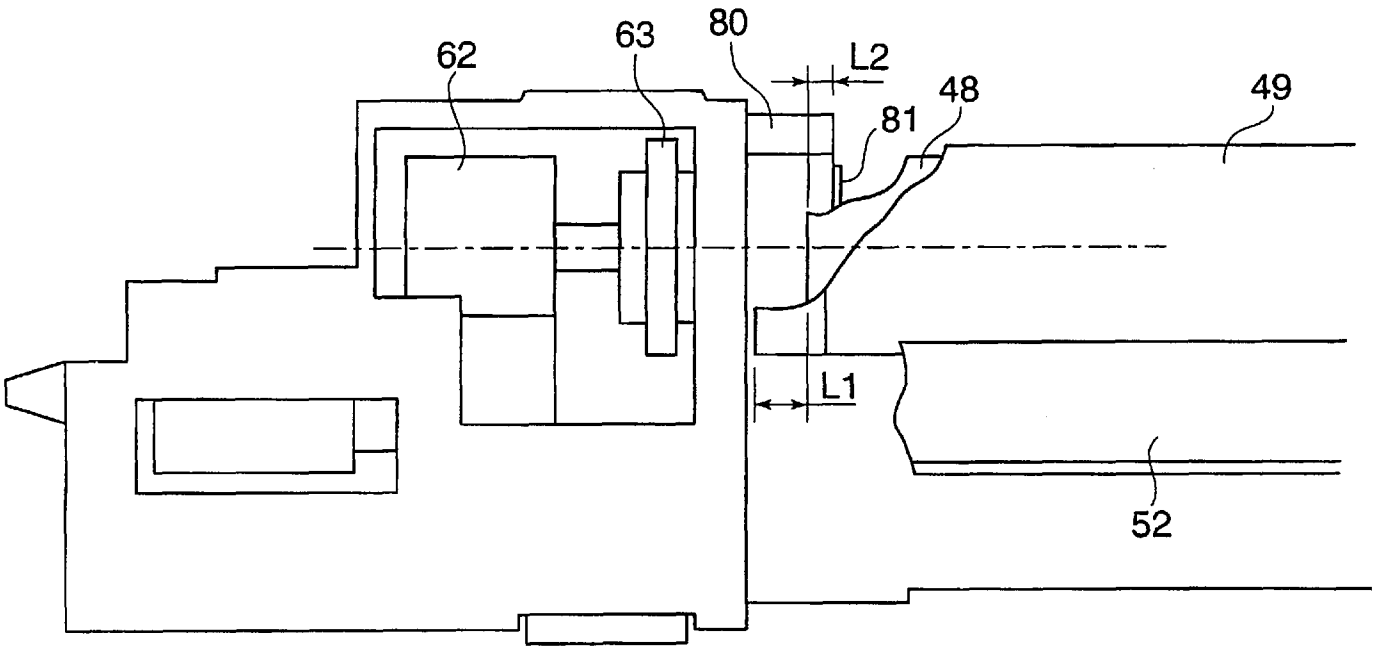
FIG. 6 is a structural view showing a relevant part of the developing unit according to the first embodiment of the present invention.

At that time, at both ends of the development roll 43 in the axial direction, as shown in FIGS. 5 and 6, an end of the magnet roll 48 is rotatably supported by a flange member 71 provided at one end of the development sleeve 49 through a bearing member 70, and a rotary shaft 72 provided on the flange member 71 of the development sleeve 49 is rotatably supported by a bearing member 73 provided on a side surface of the lower housing 46.

On the development roll 43, the diameters of the development sleeve 49 and the magnet roll 48 have been reduced with the size reduction of the developing unit 10, and the developer 50 conveyed as the development sleeve 49 rotates cannot sufficiently be peeled only by the peeling poles S2 and S3 provided on the magnet roll 48. Consequently, there is a possibility that the developer 50 having once passed through the development area and having the toner density thereof decreased is again held on the surface of the development sleeve 49 and conveyed to the development area to cause image density decrease or the like. There is also a possibility that the developer 50 leaks from an end of the development roll 43 as the particle diameter of the toner in the developer is reduced with image quality improvement.

Accordingly, in order to reliably peel the developer held on the surface of the development sleeve 49 in a position between the peeling pole S2 and the absorption pole S3 at both ends of the magnet roll 48 in the axial direction, the present embodiment is structured as follows:

At both ends of the development roll 43 in the axial direction, as shown in FIGS. 5 and 6, a protruding portion 80 protruding from the lower housing 46 is provided so as to protrude in a circular arc form over a predetermined length inward in the axial direction of the development roll 43 so as to cover the outer periphery from an upper part to the back side of the development roll 43. On an end surface of the protruding portion 80 of the lower housing 46 protruding in a circular arc form, a thin-plate-form first magnetic member 81 made of a magnetic material such as SUS is provided by non-illustrated means such as pasting by a double-faced tape. As the first magnetic member 81, for example, a thin plate made of magnetic stainless steel with a thickness of approximately 1 to 2 mm is used. As shown in FIG. 1, the first magnetic member 81 is disposed so as to correspond to the area where the magnetic force, in the normal direction, of the peeling pole S2 of the magnet roll 48 acts. The inner surface (an arc portion 81*a* described later) of the first magnetic member 81 is disposed so as to be opposed to the development roll 43 with a predetermined gap (approximately 0.5 to 1.0 mm) in between.

At both ends of the development roll 43 in the axial direction, as shown in FIG. 6, the development sleeve 49 is longer than the magnet roll 48 by a length L1, and the distance L2 between the first magnetic member 81 and the end of the magnet roll 48 is, for example, approximately 1 mm.

The first magnetic member 81 is provided with the arc portion 81*a* formed in a circular arc form along the surface of the development roll 43. The upstream side of the arc portion 81*a* in the rotation direction of the development roll is substantially linear so as to be separated from the surface of the development roll 43. The downstream side of the arc portion 81*a* is substantially linear so as to be separated from the surface of the development roll 43 so that a predetermined obtuse angle is formed.

On the downstream side of the first magnetic member 81 in the rotation direction of the development roll 43, a scraper 82 as the peeling member that peels the developer 50 by scraping it from the surface of the development roll 43 is disposed so as to adjoin or be in contact with the first magnetic member 81.

As shown in FIG. 1, an end portion 82*b* of the scraper 82 whose edge 82*a* is formed in a knife edge shape forming an acute angle is disposed so as to incline a predetermined angle with respect to the tangential line of the development roll 43 toward the downstream side in the rotation direction of the development roll 43. A lower end portion 82*c* of the scraper 82 is disposed in a condition of being bent downward in the vertical direction.

Figure 7:
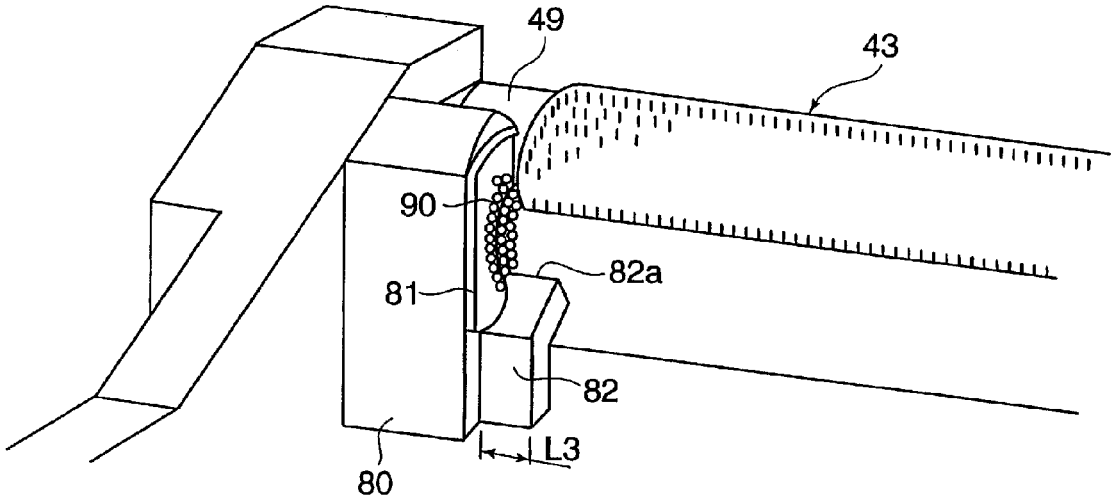
FIG. 7 is a perspective structural view showing a relevant part of the developing unit according to the first embodiment of the present invention.

As shown in FIG. 7, the scraper 82 is formed, for example, integrally with the protruding portion 80 so as to protrude a predetermined length L3 (for example, approximately 5 mm) from the end surface of the protruding portion 80 of the lower housing 46.

Further, on the downstream side of the scraper 82 in the rotation direction of the development roll 43, a thin-plate-form second magnetic member 83 made of a magnetic material such as SUS is provided on the surface of the protruding portion 80 by means such as pasting by a double-faced tape. The second magnetic member 83 is disposed over an area from the upstream side of the absorption pole S3 to the conveyance pole N2 of the magnet roll 48 which area ranges from the neighborhood on the downstream side of the scraper 82 in the rotation direction of the development roll 43 to the upstream side of the developer restricting member 52. The second magnetic member 83 is provided mainly for preventing the leakage of developer from an end of the development roll 43 by forming a magnetic brush of developer in a gap from the magnet roll 48.

In the above-described structure, in the color printer to which the developing unit according to the present embodiment is applied, density unevenness such as density decrease in an end portion of the developer holding member in the axial direction is prevented in the following manner even when the size of the developing unit or the diameter of the developer holding member is reduced:

That is, in the above-described color printer, as shown in FIG. 2, electrostatic latent images corresponding to image data are formed on the photoconductor drums 8Y, 8M, 8C and 8K of the image forming units 6Y, 6M, 6C and 6K of yellow (Y), magenta (M), cyan (C) and black (K), the electrostatic latent images formed on the photoconductor drums 8Y, 8M, 8C and 8K are developed into toner images by the developing units 10Y, 10M, 10C and 10K. The toner images of yellow (Y), magenta (M), cyan (C) and black (K) formed on the photoconductor drums 8Y, 8M, 8C and 8K are transferred onto the intermediate transfer belt 13 so as to be superimposed one on another, secondarily transferred onto the recording sheet 19 all together, and fixed. In this manner, a full-color or monochrome image is formed.

In the developing units 10Y, 10M, 10C and 10K, as shown in FIG. 1, the developer 50 is absorbed to the surface of the development sleeve 49 by the magnetic force of the magnet roll 48 and conveyed to the development area opposed to the photoconductor drum 8 as the development sleeve 49 rotates, and the electrostatic latent image formed on the surface of the photoconductor drum 8 is developed with the toner in the magnetic brush of the developer 50. Thereafter, the developer 50 held on the surface of the development sleeve 49 is conveyed to the peeling pole S2 through the conveyance pole N1 of the magnet roll 48 as the development sleeve 49 rotates, and peeled from the surface of the development sleeve 49 between the peeling pole S2 and the absorption pole S3. Then, new developer 50 is supplied to the surface of the development sleeve 49 at the absorption pole S3, and moves again to the development area through the conveyance pole N2.

Figure 8:
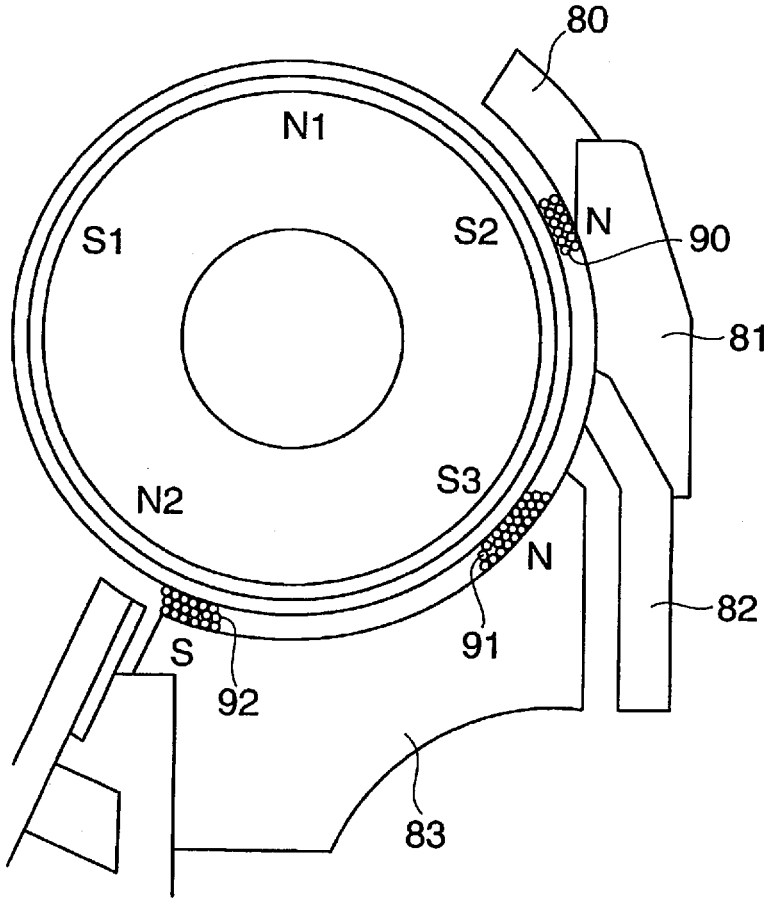
FIG. 8 is a structural view showing the working of the developing unit according to the first embodiment of the present invention.

At that time, in the developing unit 10, since the first magnetic member 81 is disposed in a position corresponding to the peeling pole S2 of the magnet roll 48 as shown in FIG. 1, a magnetic field is generated between the peeling pole S2 of the magnet roll 48 and the first magnetic member 81 as shown in FIG. 8, and a magnetic brush 90 of the developer 50 is formed in the area where the magnetic field is generated.

The magnetic brush 90 formed between the magnet roll 48 and the first magnetic member 81 also functions as an end seal between the development sleeve 49 and the protruding portion 80 of the lower housing 46, and prevents the leakage of the developer 50 from the end of the development sleeve 49.

Moreover, in the developing unit 10, since the scraper 82 is provided on the downstream side of the first magnetic member 81 in the rotation direction of the development sleeve 49 as shown in FIG. 1, as described above, the magnetic brush 90 (chain-like developer) formed between the magnet roll 48 and the first magnetic member 81 retains the developer 50 moving downstream as the development sleeve 49 rotates as shown in FIG. 7, and even when the developer 50 retained in the position of the first magnetic member 81 reaches a certain amount and starts to move downstream in the rotation direction of the development sleeve 49, the developer 50 is reliably peeled from the surface of the end surface in the axial direction of the development sleeve 49 by the scraping by the scraper 82. That is, density unevenness such as density decrease in the axial direction of the developer holding member is prevented by peeling the developer having passed the development pole S1, from the surface of the development sleeve 49 and absorbing new developer to the development sleeve 49 for development.

Further, in the developing unit 10, since the second magnetic member 83 is provided on the downstream side of the scraper 82 in the rotation direction of the development sleeve 49 as shown in FIG. 1, a magnetic field is generated between the absorption pole S3 and the conveyance pole N2 of the magnet roll 48 and the second magnetic member 83 as shown in FIG. 8, and magnetic brushes 91 and 92 of the developer 50 are formed in the area where the magnetic field is generated. The magnetic brushes 91 and 92 formed between the magnet roll 48 and the second magnetic member 83 function as end seals between the development sleeve 49 and the lower housing 46, and prevent the leakage of the developer from the end of the development sleeve 49.

Next, the inventor of the present invention prototyped the developing unit 10 as shown in FIG. 1, and performed a test in which a toner image of each color was continuously formed on the entire surfaces of ten A3-size recording sheets 19 with an image density of 100% under a condition where the developing unit 10 was attached to a color printer as shown in FIG. 2 and for the tenth recording sheet 19, it was checked whether or not an image density decrease occurred in end portions of approximately 5 to 6 mm of the recording sheet 19 corresponding to both ends of the development roll 43 in the axial direction.

At that time, for a developing unit as a second test example in which the first magnetic member 81 was not provided and only the second magnetic member 83 was used together with the scraper 82, a test was also performed in which it was checked whether an image density decrease occurred or not.

Figure 10:
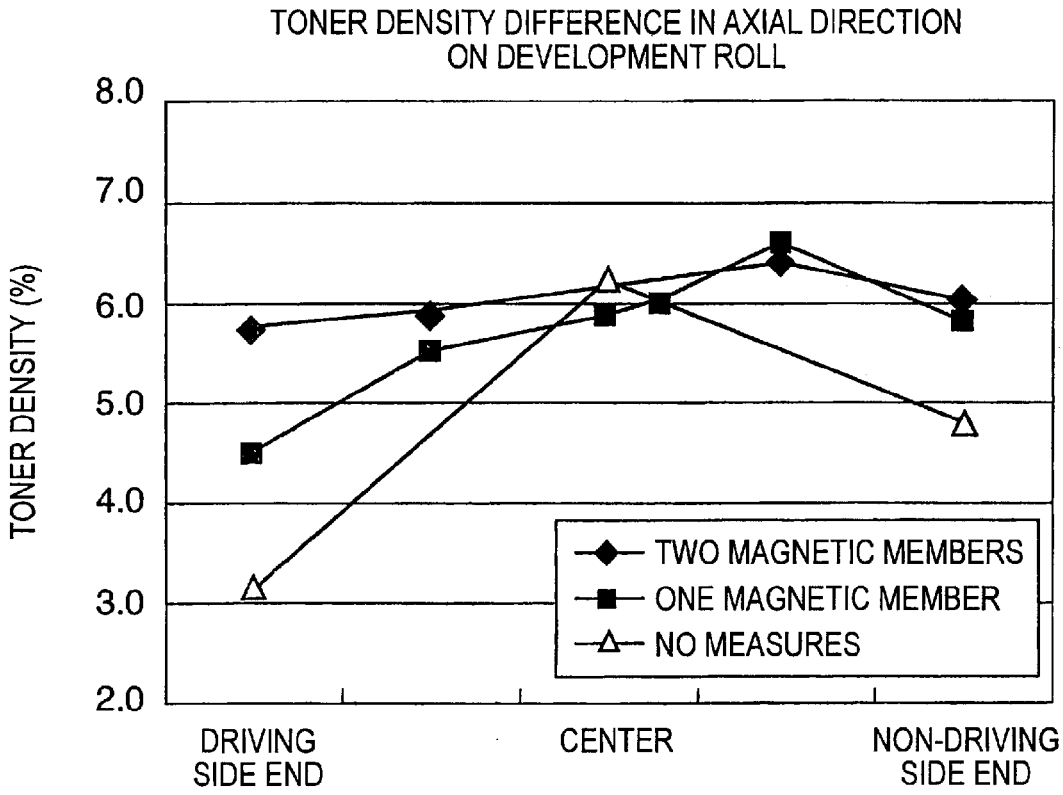
FIG. 10 is a graph showing a test result.

FIGS. 9 and 10 are graphs showing the results of the first and second test examples.

As is apparent from these FIGS. 9 and 10, it has been found that by using the first and second magnetic members 81 and 83 together with the scraper 82, the occurrence of image density decrease can be significantly suppressed compared with developing units not provided with these magnetic members and thus, provided with no measures against the density decrease.

Moreover, as is apparent from FIG. 9, it has been found that in the developing unit not provided with the first magnetic member 81 but using only the second magnetic member 83 together with the scraper 82, the occurrence of image density decrease can be suppressed compared with developing units not provided with this magnetic member. The symbols show the improving degree of the image density decrease compared with no magnetic members. Specifically, the triangle symbol shows the image density decrease is suppressed, and the circle symbol shows the image density decrease is significantly suppressed.

Second Embodiment

Figure 11:
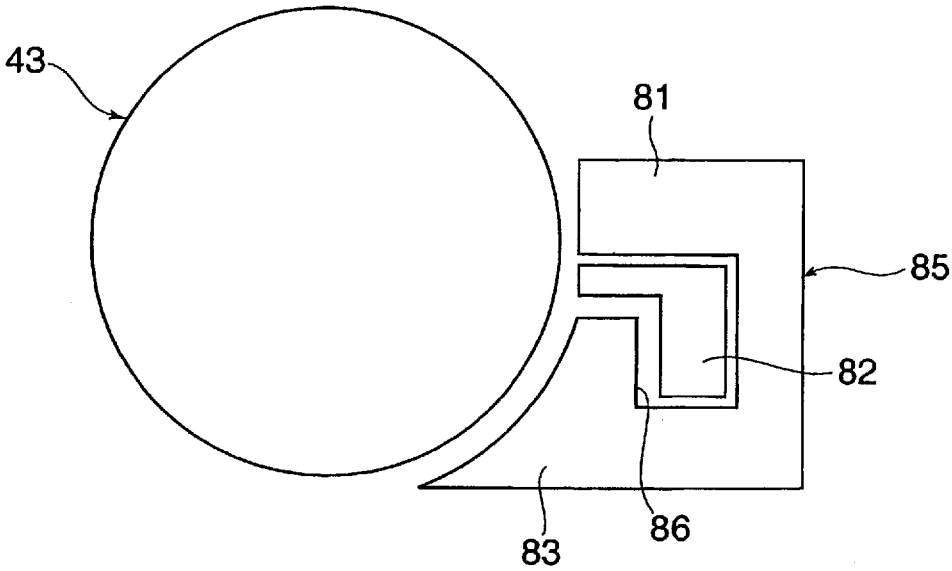
FIG. 11 is a schematic structural view showing a relevant part of a developing unit according to a second embodiment of the present invention.

FIG. 11 shows a second embodiment of the present invention. Providing a description with the same parts as those of the first embodiment being denoted by the same reference numerals, in the second embodiment, the magnetic member for developer leakage prevention is one in which the two magnetic members provided on the upstream and downstream sides of the peeling member in the axial direction of the developer holding member are integrally formed.

That is, in the second embodiment, as shown in FIG. 11, the first magnetic member 81 and the second magnetic member 83 are formed as an integral magnetic member 85. The integral magnetic member 85 is provided with a concave groove 86 for inserting an end of the scraper 82.

The structures other than this and the workings will not be described since they are similar to those of the above-described embodiment.

While in the above-described embodiment, the magnetic members are provided on both the upstream and downstream sides of the peeling member in the axial direction of the developer holding member, it is not always necessary to provide the magnetic member on both the upstream and downstream sides of the peeling member in the rotating direction of the developer holding member, and it is necessary to provide it on at least one of the upstream and downstream sides in the axial direction of the development holder.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing unit comprising:

a cylindrical magnetic member having a plurality of magnetic poles in a circumferential direction, the plurality of magnetic poles including a first pole attracting developer and a second pole not attracting developer;

a developer holding member that has the cylindrical magnetic member therein and conveys developer magnetically attracted by the cylindrical magnetic member on a surface thereof in a direction toward a predetermined area where developer is not attracted by a magnetic field caused by the second pole;

a peeling member that is provided in the predetermined area and peels off the developer attracted at an end portion of the developer holding member in an axial direction; and a second magnetic member that is provided on at least one of an upstream side opposed to the predetermined area and a downstream side of the peeling member, and that is disposed in a position with a gap from the surface of the developer holding member, wherein the peeling member is provided only at a position corresponding to the end portion of the developer holding member in the axial direction, wherein the peeling member contacts the surface of the developer holding member.

2. The developing unit according to claim 1, wherein the second magnetic member is situated corresponding to the second pole of the cylindrical magnetic member.

3. The developing unit according to claim 1, wherein the second magnetic member includes two magnetic members provided at end portions in the axial direction of the developer holding member on the upstream side and the downstream side of the peeling member, and are disposed with the gap from the surface of the developer holding member.

4. The developing unit according to claim 1, wherein the second magnetic member includes a first portion provided on the upstream side of the peeling member and a second portion provided on the downstream side of the peeling member.

5. The developing unit according to claim 1, wherein the second magnetic member forms a magnetic brush between the developer holding member and the second magnetic member.

6. The developing unit according to claim 5, wherein the peeling member peels off the magnetic brush.

7. The developing unit according to claim 5, wherein the peeling member prevents leakage of the developer from the developer holding member.

8. The developing unit according to claim 1, wherein the second magnetic member has a concave groove for inserting an end of the peeling member.

9. An image forming apparatus comprising:

an image holder where an electrostatic latent image is formed on a surface thereof;

a cylindrical magnetic member having a plurality of magnetic poles in a circumferential direction, the plurality of magnetic poles including a first pole attracting developer and a second pole not attracting developer;

a developer holding member that has the cylindrical magnetic member therein and conveys developer magnetically attracted by the cylindrical magnetic member on a surface thereof in a direction toward a predetermined area where developer is not attracted by a magnetic field caused by the second pole;

a peeling member that is provided in the predetermined area and peels off the developer attracted at an end portion of the developer holding member in an axial direction; and a second magnetic member that is provided on at least one of an upstream side opposed to the predetermined area and a downstream side of the peeling member, and that is disposed in a position with a gap from the surface of the developer holding member, wherein the peeling member is provided only at a position corresponding to the end portion of the developer holding member in the axial direction, wherein the peeling member contacts the surface of the developer holding member.

10. The image forming apparatus according to claim 9, wherein the second magnetic member forms a magnetic brush between the developer holding member and the second magnetic member.

11. The image forming apparatus according to claim 10, wherein the peeling member peels off the magnetic brush.

12. The image forming apparatus according to claim 10, wherein the peeling member prevents leakage of the developer from the developer holding member.

13. The image forming apparatus according to claim 9, wherein the second magnetic member has a concave groove for inserting an end of the peeling member.

* * * * *